United States Patent [19]

Namiki et al.

[11] 4,172,976

[45] Oct. 30, 1979

[54] HEAT ROLLER FIXING APPARATUS

[75] Inventors: Ryoichi Namiki, Hino; Yuichiro Higashi, Kawasaki; Toshiyuki Kikuchi, Yokohama; Ichiro Fukushima, Tokyo; Yasuo Asahina, Tokyo; Setsuo Soga, Mitaka, all of Japan

[73] Assignee: Ricoh Co., Ltd., Tokyo, Japan

[21] Appl. No.: 836,413

[22] Filed: Sep. 26, 1977

[30] Foreign Application Priority Data

| | | | |
|---|---|---|---|
| Sep. 27, 1976 | [JP] | Japan | 51-115547 |
| Oct. 20, 1976 | [JP] | Japan | 51-125916 |
| Nov. 30, 1976 | [JP] | Japan | 51-143795 |
| Dec. 3, 1976 | [JP] | Japan | 51-145221 |

[51] Int. Cl.[2] ..... H05B 3/02; B21B 27/06

[52] U.S. Cl. ..... 219/469; 165/89; 219/216; 219/530; 432/60

[58] Field of Search ..... 219/216, 469, 470, 471, 219/530; 29/113 AD; 165/89, 185; 432/8, 60, 228; 427/27

[56] References Cited

U.S. PATENT DOCUMENTS

| | | | |
|---|---|---|---|
| 2,739,218 | 3/1956 | Wennerlund | 219/469 |
| 2,824,721 | 2/1958 | Hill | 219/469 X |
| 2,831,097 | 4/1958 | Malewski | 219/469 |
| 3,020,383 | 2/1962 | Omishi et al. | 219/470 |
| 3,105,133 | 9/1963 | Norton | 219/469 |
| 3,146,078 | 8/1964 | Gerster | 219/469 X |
| 3,423,573 | 1/1969 | Richards et al. | 219/469 |
| 3,548,928 | 12/1970 | Kesten | 219/469 |
| 3,951,585 | 4/1976 | Fujimoto | 219/469 |
| 4,091,264 | 5/1978 | Sarcia | 219/469 |

FOREIGN PATENT DOCUMENTS

| | | | |
|---|---|---|---|
| 1544792 | 9/1968 | France | 219/469 |

*Primary Examiner*—Volodymyr Y. Mayewsky
*Attorney, Agent, or Firm*—Cooper, Dunham, Clark, Griffin & Moran

[57] ABSTRACT

Improved heat roller fixing apparatus comprising an inner cylinder having a heater therein, an outer cylinder, and a vacuum chamber which is formed between the inner cylinder and the outer cylinder and which contains a liquid heat transfer medium at low pressure is described. In particular, improvements obviating excessive heating of the inner cylinder are made by placing the heat transfer medium in the chamber so as to be in contact with the lower portion of the inner cylinder at least when said outer cylinder is stationary, or by mounting on the inner cylinder a member which serves to stir or pour the heating medium on the inner cylinder and also to transfer heat indirectly from the inner cylinder to the outer cylinder through the heating medium so that speedy evaporation of the heating medium and safe and stable fixing of images are accomplished.

2 Claims, 10 Drawing Figures

FIG. 1
PRIOR ART
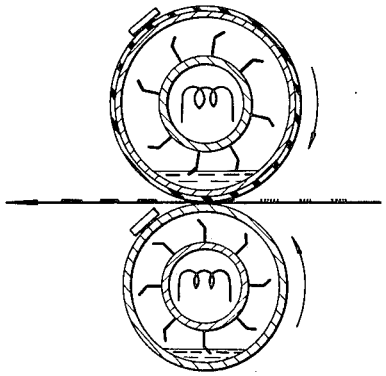
FIG. 2
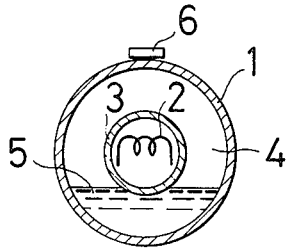
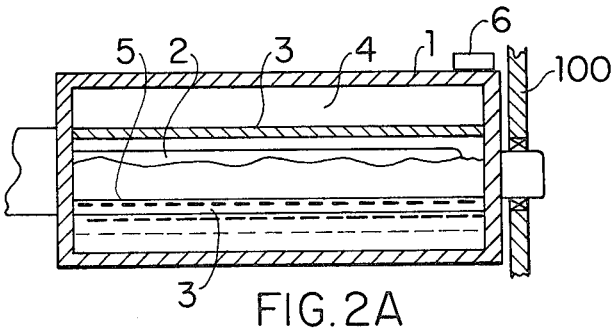
FIG. 2A

HEAT ROLLER FIXING APPARATUS

BACKGROUND OF THE INVENTION

This invention relates to a heat roller fixing apparatus. In an electrophotographic copying machine or an electrostatic recording machine, a fixing apparatus for fixing images on a sheet or supporting material is incorporated. One example of such apparatus is a fixing roller for heat fusing the image.

In one conventional heat fixing apparatus, a pair of fixing rollers is provided each having a chamber containing a heat transfer or heating medium, which is sealed therein and connected to saturated vapor by a heater incorporated within a cylinder inside the roller. The rollers are disposed in contact with each other and a sheet or supporting material having an image to be fixed thereon is fed between them and heated by the rollers so that the image is fixed by heat fusing.

In the above-mentioned fixing rollers, the temperatures of the surfaces of the respective rollers are detected by a temperature detecting means, such as a thermistor, disposed on the surfaces of the respective rollers, and a necessary command is given to control means for the heater so that the fixing temperature of the respective roller surfaces is determined. This sort of fixing apparatus, however, has the shortcoming that the heating medium sealed in the chamber of the fixing roller is small in quantity as shown in FIG. 1. As a result such a small quantity of heat transfer medium lies at the bottom of each chamber, and its upper surface does not come in contact with the inner cylinder holding the heater therein when the respective rollers are stationary. Therefore, when the heaters are energized while the rollers are stationary, the respective inner cylinders are heated, but heat is not readily transferred to the heating medium, and accordingly not to the surface of the respective rollers as the heating medium is not in contact with the inner cylinder. Therefore, the temperature detecting means, which is disposed in contact with the surface of the respective rollers, does not detect the accurate temperature of the heat to be transferred from the inner cylinder, and it gives the control means of the heater a wrong command demanding more heat. As a result, the inner cylinder is heated excessively, causing a very dangerous situation of damaging the inner cylinder.

In order to prevent the above-mentioned accident, conventionally the following apparatus have been devised: apparatus wherein a detecting means, which detects the rotation of the heating roller, is incorporated whereby the heater is energized only when the heating roller is being rotated; and apparatus wherein blades are attached to the inner cylinder which scoop up the heat conductive medium as the inner cylinder rotates as shown in FIG. 1.

However the former apparatus has the shortcomings that the detecting means is not reliable and the apparatus is expensive while the latter apparatus is intricate in mechanism. Therefore, investigations to remove the above-mentioned problems from the heat fixing roller have been necessitated.

SUMMARY OF THE INVENTION

A principal object of the present invention is to provide an improved heat roller fixing apparatus which has a high thermal efficiency and does not cause any excessive heating of the heat roller fixing apparatus so that a safe and stable fixing of images can be accomplished.

In one embodiment of the fixing roller according to the present invention, the quantity of a heating medium, contained at low pressure in the vacuum chamber of the heating roller, is such that the heating medium comes in contact with the lower peripheral surface of an inner cylinder having a heater therein. Therefore according to this embodiment, even if the inner cylinder is heated while the roller is not rotated, heat is transferred stably from the inner cylinder to the outer cylinder through the heating medium and the roller is heated uniformly. Therefore such an accident as the inner cylinder being excessively heated without being in contact with the heating medium is obviated. It follows that control of the fixing temperature by use of temperature detecting means can be made securely.

In another embodiment of the fixing roller according to the invention, an intermediate cylinder provided with a number of apertures is mounted on the inner cylinder. Here the quantity of the heating medium is so reduced that the heating medium does not directly come into contact with the inner cylinder as in the first embodiment, but it is in contact with the intermediate cylinder. Thus heat is transferred from the inner cylinder to the outer cylinder through the intermediate cylinder and also by radiation. According to this embodiment, direct heating of the heating medium by the high temperature inner cylinder is obviated. Furthermore, since the heating medium used is small in quantity, the efficiency of heat transfer is increased. In a further embodiment according to the invention, in order to prevent more efficiently direct heating of the heating medium and deterioration of the heating medium by such direct heating, heat resisting wicks are provided between the inner cylinder and the intermediate cylinder.

In still another embodiment of the invention, a heat transfer ring is employed instead of the intermediate cylinder. This heat transfer ring covers the inner cylinder loosely and is hung from the inner cylinder. In this embodiment the heating medium is not in contact with the inner cylinder, but is in contact with the lower end of the heat transfer ring. This ring has also various advantages as in the above-mentioned intermediate cylinder.

In a final embodiment of the invention, a plurality of heat conductive members are incorporated in the vacuum chamber between the inner cylinder and the outer cylinder. These heat conductive members are also effective in preventing direct heating of the heating medium by the inner cylinder and also in promoting stable and uniform vaporization of the heating medium as in the above-mentioned embodiments.

BRIEF DESCRIPTION OF THE DRAWINGS

FIG. 1 is a schematic sectional side elevation of one example of the conventional fixing apparatus using a pair of heating rollers;

FIG. 2 is a schematic sectional side elevation of one of a pair of heating rollers employed in one embodiment of the fixing apparatus according to the present invention;

FIG. 2A is a front view, partly in section, of the embodiment shown in FIG. 2.

DETAILED DESCRIPTION OF THE PREFERRED EMBODIMENTS

Figure 3:
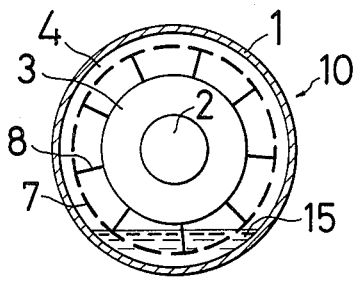
FIG. 3 is a schematic sectional side elevation of one of the heating rollers employed in another embodiment of the fixing apparatus of the invention.

FIG. 2 is a schematic sectional side elevation of one of a pair of heating rollers employed in one embodiment of the fixing apparatus according to the invention. In the figure, an outer cylinder 1 is a heat conductive roller whose outer peripheral surface is covered with a material excellent in surface lubrication, such as silicone rubber. Inside the outer cylinder 1 is disposed an inner cylinder 3 having a heater 2 therein comprising a material with high electric resistance such as an infrared heater and nichrome wire. The inner cylinder 3 and the outer cylinder 1 are made integral at the respective lateral ends thereof and supported rotatably by a side plate 100 as shown in FIG. 2A.

Between the outer cylinder 1 and the inner cylinder 3 is formed a vacuum chamber 4 which is kept at low pressure. The vacuum chamber 4 contains a heating medium 5 comprising a liquid with comparatively high vapor pressure, such as water and alcohol. The quantity of the heating medium 5 is as much as will come in contact with the lower peripheral surface of the inner cylinder 3 as shown in FIG. 2 when the heating roller is not being rotated and the temperature of the outer surface of the roller reaches a predetermined fixing temperature. Furthermore, a temperature detecting means 6, such as a thermistor, is disposed at an appropriate position on the outer cylinder and electrically connected with a heat control means, not shown, of the heater.

The heat roller fixing apparatus is constructed with a pair of the above-mentioned heating rollers in combination thereof with a belt which rotates in contact with the lower surface of the roller.

In the fixing apparatus of the present invention, when the heater 2 disposed in the inner cylinder 3 is energized and generates heat, the inner cylinder 3 is heated and accordingly the heating medium 5 is also heated, whereby the heating medium 5 in the chamber 4 reaches its saturation temperature and is vigorously evaporated and the chamber 4 is gradually filled with the vapor of the heating medium. Through the heating medium vapor, heat is transferred to the outer cylinder 1. As a result, the surface temperature of the cylinder 1 is raised. The surface temperature of the cylinder 1 is detected by the temperature detecting means 6, and by this detection a command is transferred to the control member of the heater. Thus the control member controls the heater so as to cause the surface temperature of the cylinder 1 to be kept constant at a predetermined temperature.

The inventors of the present invention conducted the following experiments: Firstly a heater was incorporated inside the conventional heating roller containing a small quantity of the heating medium. With the roller stopped, the heater was energized. As a result it was found that only the inner cylinder was heated and that the surface termperature of the outer cylinder scarcely changed. Secondly a 500 W heater was incorporated inside the heating roller according to the present invention in FIG. 2 and the surface temperature of the outer cylinder was measured with time with the roller stopped. The results showed that the surface temperature of the outer cylinder of the present invention was approximately the same as that of the conventional heating roller with rotation. However, the temperature of the upper surface of the roller was higher by approximately 1° to 5° C. than the lower surface of the roller. This certainly indicates that the saturated vapor of the heating medium transferred heat sufficiently. Finally, the surface temperature of the outer cylinder was measured with the heating roller being rotated. The same results as in the above experiment were obtained with respect to the temperature characteristics and uniform temperature distribution. Therefore it was found that this method was significantly effective is producing a safe fixing roller.

The above-mentioned temperature detecting means 6 can be placed in contact with the surface of the outer cylinder within the area corresponding to the inner surface of the outer cylinder where the heat transporting material stays.

In FIG. 3, an intermediate cylinder 7, for preventing the inner cylinder 3 from being heated excessively when not in touch with a liquid heating medium 15, is disposed in sealed vacuum chamber 4 formed between the inner cylinder 3 and the outer cylinder 1 of roller 10, and the intermediate cylinder 7 is fixed on the inner cylinder 3 through a plurality of support arms 8. The liquid heating medium 15 contained in the sealed vacuum chamber 4 is so small in quantity that the lower peripheral surface of the inner cylinder 3 does not directly come in contact with the surface of the liquid heating medium 15. On the other hand the lower peripheral surface of the intermediate cylinder 7 is always immersed in the liquid heating medium 15. The intermediate cylinder 7 is constructed of a member having apertures, such as a punched metal plate or a wire net. By mounting the intermediate cylinder 7 on the inner cylinder 3, heat is transferred from the inner cylinder 3 to the intermediate cylinder 7 by radiation and by conduction through the support arms 8, and then transferred to the liquid heating medium 15. Therefore, even while the roller 10 is stationary, the temperature of the heating medium 15 is increased so that the heating medium evaporates. As long as an appropriate amount of the vapor of the liquid heating medium 15 exists in the vacuum chamber 4, both the inner cylinder 3 and the outer cylinder 1 are at elevated temperatures so that the excessive heating of the inner cylinder 3 and the heater 2 is prevented. Since the liquid heating medium 15 is heated by the intermediate cylinder 7, it is unnecessary to immerse the inner cylinder 3 in the heating medium unlike the modification of the conventional heating roller of FIG. 2. As a result, the distance between the inner cylinder 3 and the heater 2 can be reduced and the temperature of the inner cylinder 3 can be elevated more speedily. Also the amount of the heating medium to be used can be reduced and evaporated more speedily and efficiently. In other words, since the heater is disposed substantially closer to the liquid heating medium 15, the temperature of the roller 10 is elevated uniformly even while the roller 10 is stationary. Thus excessive heating of the roller without being in sufficient contact with the heating medium, or damage to the roller caused by such heating can be obviated.

Figure 4:
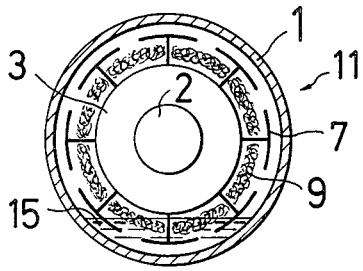
FIG. 4 is a schematic sectional side elevation of one of the heating rollers employed in a further embodiment of the fixing apparatus of the invention.

FIG. 4 shows a further embodiment of the heating roller according to the present invention. Wicks 9 are provided between the inner cylinder 3 and the intermediate cylinder 7. The wicks 9 are made of a heat resisting fiber, such as glass fiber, steel wool or ceramic wool, to they draw up the liquid heating medium 15 and supply the peripheral surface of the inner cylinder 3 with the heating medium and form a film of the liquid heating medium on the inner cylinder, with the result that evaporation of the heating medium is promoted further and the excessive heating of the roller due to lack of sufficient contact with the heating medium is obviated while the roller is stationary. Furthermore, when the roller is rotated, the supply of liquid heating medium is not directly brought into contact with the heated inner cylinder, but after it has been brought into contact with the wicks, it comes in contact with the inner cylinder and is then heated by the inner cylinder. Therefore, deterioration of the liquid heating medium is advantageously reduced.

When the space between the inner cylinder 3 and the intermediate cylinder 7 is filled with the wicks 9, heat transfer through the vapor of the liquid heating medium may be hindered. However, since there is a sufficient space between the intermediate cylinder 7 and the outer cylinder 1, the heat performance of the heating medium is not hindered. Furthermore, since the liquid heating medium 15 is not abruptly poured on the high temperature inner cylinder 3 when the roller 11 is rotated, deterioration of the liquid heating medium 15 by pyrolysis is obviated.

Figure 5:
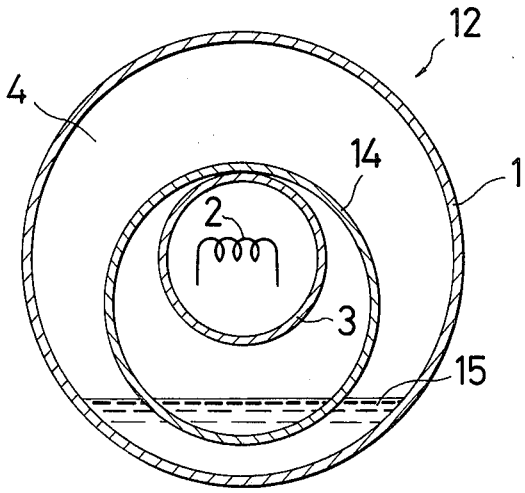
FIG. 5 is a schematic sectional side elevation of one of the heating rollers employed in still another embodiment of the fixing apparatus of the invention.

In FIG. 5, the heating roller 12 comprises a heat conductive inner cylinder 3 having a heater 2 therein made of an electrically high resistant material, such a nichrome wire; a heat conductive outer cylinder 1 which is made integral with the inner cylinder 3 by a member (not shown) at the respective ends of both cylinders; liquid heating medium 15 which is contained at low pressure in the vacuum chamber 4 formed between the inner cylinder 3 and the outer cylinder 1; a heat transfer ring 14 through which the inner cylinder 3 passes and which is hung from the inner cylinder in the manner that one region is in contact with part of the surface of the inner cylinder 3 and the other end being immersed in the liquid heating medium 15. The ring 14 is approximately as wide as the inner cylinder 3. It may be possible to provide an induction heating means (not shown) which heats directly the inner ring 14 in order to heat the liquid heating medium 15.

The ring 14 is made of a material having high heat conductivity such as a metal plate. Its thickness and diameter can be determined in accordance with the temperature characteristics of the roller.

In this embodiment, when the heater 2 is energized, the inner cylinder 3 is heated and heat is transferred from the inner cylinder 3 to the liquid heating medium 15 through the heat transfer ring 14 either when the roller 12 is stopped or when it is rotated, with the result that the temperature of the liquid heating medium 15 is increased. The liquid heating medium 15 is vigorously vaporized when the temperature of the liquid reaches its boiling point. By this vapor, the surface temperature of the outer cylinder is maintained at a predetermined fixing temperature. Furthermore, the heat transfer ring 14 may be rotated together with the inner cylinder 3 when the roller 12 is rotated, whereby the liquid heating medium 15 is poured on the surface of the inner cylinder 3 so that vaporization of the liquid heating medium is promoted further.

The heat transfer ring 14 does not necessarily have to be approximately as wide as the inner cylinder 3. It can be divided into segments. Also the heat transfer ring 14 can be provided with a large number of apertures in order to facilitate the flow of the liquid heating medium 15 in the vacuum chamber of the roller. Furthermore, instead of the ring, coils, double rings or double cylinders can be used. When a double coil is employed, it is perferable to reverse the respective winding directions of an outer coil and an inner coil to attain good circulation of the liquid heating medium inside the vacuum chamber.

Figure 6:
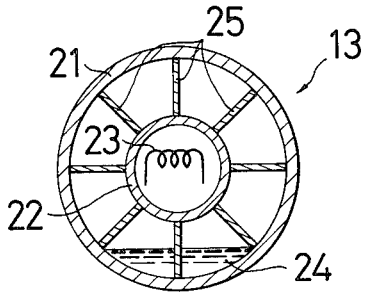
FIG. 6 is a schematic sectional side elevation of one of the heating rollers employed in a still further embodiment of the fixing apparatus of the invention.
Figure 7:
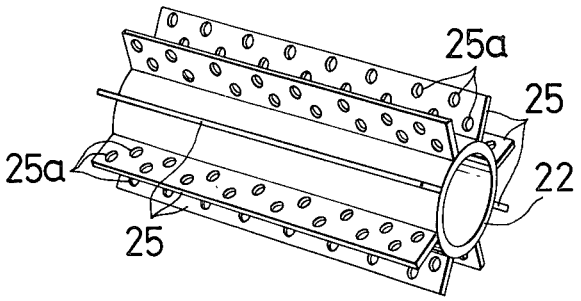
FIG. 7 is a partial perspective view of the embodiment of FIG. 6.

In FIG. 6, a heating roller 13 comprises an inner cylinder 22 with high heat conductivity having a heater 23 therein; a heat conductive outer cylinder 21 which is made integral with the inner cylinder 22 at the respective ends of both cylinders by a member (not shown); a liquid heating medium 24 which is contained at a low pressure in the sealed vacuum chamber formed between the inner cylinder 22 and the outer cylinder 21; and heat conductive members 25 whose respective ends on the one side are attached to the outer peripheral surface of the inner cylinder 22 at a plurality of positions thereof and whose respective ends on the other side are in contact with the inner surface of the outer cylinder 21. The heat conductive members 25 are made of a material with high heat conductivity such as metal plate and they are provided with a number of openings 25*a* (refer to FIG. 7). The openings 25*a* are formed in order to facilitate the flow of the liquid heating medium within the vacuum chamber through the openings while the roller is being rotated.

In this embodiment, when the heater 23 is energized during rotation of the roller, the inner cylinder 22 is heated and heat is transferred from the inner cylinder 22 to the liquid heating medium 24 through the heat conductive members 25. At the same time, since the liquid heating medium 24 is stirred by the heat conductive members 25 and poured on the surface of the inner cylinder, vaporization of the liquid heating medium 25 is promoted and the surface temperature of the outer cylinder is maintained at a predetermined fixing temperature by the vaporized heating medium.

Furthermore, when the inner cylinder 22 is heated by the heater 23 while the roller is stationary, heat is transferred from the inner cylinder 22 to the liquid heating medium 24 through the heat conductive members 25 so that vaporization of the liquid heating medium is promoted. At the same time, heat is transferred to the outer cylinder 21 which is in contact with the heat conductive members 25. Therefore, it follows that heat is transferred from the inner cylinder to the outer cylinder 21 irrespective of the rotation of the roller.

As a material of the heat conductive members 25 according to the present invention, an elastic material can be used since the ends of each member of the heat conductive members slide along the inner surface of the outer cylinder. As a matter of course, the shape and number of openings 25*a* is determined in accordance with the characteristics of the fixing roller.

Figure 8:
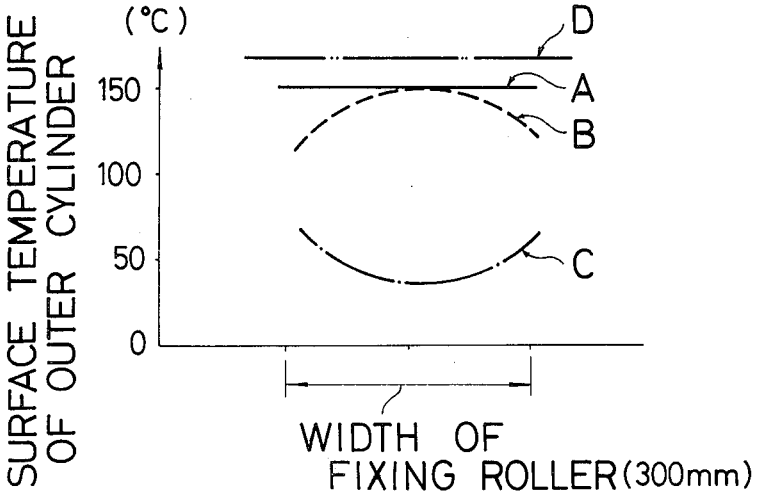
FIG. 8 is a graph showing how the embodiment of FIG. 6 is effective in heat transfer in comparison with the embodiment of FIG. 2.

The inventors of the present invention investigated changes of the respective surface temperatures of the heating roller shown in FIG. 2 and the above-mentioned roller while the respective rollers were stopped. FIG. 8 shows the results of this investigation. The graph shown in FIG. 8 was obtained by measuring the surface temperature of the respective outer cylinders in 5 minutes after 300 W was applied to the heater 2 in FIG. 2 and the heater 23 in FIG. 6. In the graph, A indicates the heating roller in FIG. 6 with the liquid heating medium and B indicates the heating roller in FIG. 6 without the liquid heating medium. C indicates the heating roller in FIG. 2 and D indicates the temperature of the respective inner cylinders. As can be seen from this graph, the difference between the surface temperatures A, B of the outer cylinder and that of the inner cylinder of the heating roller in FIG. 6 is considerably smaller than that between the surface temperature of the outer cylinder and that of the inner cylinder of the heating roller in FIG. 2. This indicates that the heat transfer of the heating roller of FIG. 6 is more efficient than that of the heating roller of FIG. 2.

Figure 9:
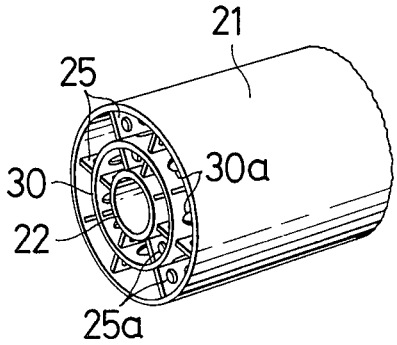
FIG. 9 is a partial perspective view of a further embodiment of the invention.

In the embodiment of FIG. 6, the ends of the heat conductive members 25 on one side are not necessarily attached to the inner cylinder 22, but as shown in FIG. 9, with the ends on one side being in contact with the inner cylinder and those on the other side being in contact with the inner surface of the outer cylinder, each of the heat conductive members can be secured side by side to a junction support member 30 which is disposed between both the cylinders and which is supported at its end by the member (not shown) making both the cylinders integral at both sides thereof. Furthermore, support member 30 between each of the heat conductive members 25, can be provided with openings 30*a* with appropriate shape so that the efficiency of heat transfer from the inner cylinder to the outer cylinder is raised. In this case, an appropriate heat insulating member such as steel wool or glass fiber can be placed between the inner cylinder and the above-mentioned junction support member 30 so that the efficiency of heat transfer can be raised much more.

What is claimed is:

1. In a heat fixing roller apparatus of the type comprising:

an inner cylinder of a heat-conductive material having electric heater means therein for heating said inner cylinder;

an outer cylinder of a heat-conductive material integral with said inner cylinder at the respective ends thereof and concentrically disposed with respect thereto; and a uniform cylindrical vacuum chamber formed between said inner cylinder and said outer cylinder, which chamber contains a heat-conducting medium for transferring heat between said inner and outer cylinders;

the improvement wherein said heat-conducting medium comprises a body of vaporizable liquid having a comparatively high vapor pressure and of a volume less than half that of said vacuum chamber such that only the lower surface of said inner cylinder is immersed in and in direct contact with said liquid when said heat fixing roller apparatus is stationary and unheated whereby heat is immediately transferred between said stationary inner and outer cylinders by said medium in its liquid state upon initial heating and is then rapidly transferred between them uniformly by said medium in its vapor state upon evaporation into said vacuum chamber.

2. A roller apparatus as in claim 1 wherein said vaporizable liquid comprises water and alcohol.

* * * * *